United States Patent [19]

Malcolm

[11] 4,062,609

[45] Dec. 13, 1977

[54] SPRING CONTACT FOR HIGH FREQUENCY ELECTRICAL SIGNALS

[75] Inventor: Bruce G. Malcolm, Indianapolis, Ind.

[73] Assignee: Texscan Corporation, Indianapolis, Ind.

[21] Appl. No.: 712,494

[22] Filed: Aug. 9, 1976

[51] Int. Cl.[2] ..... H01R 39/00

[52] U.S. Cl. ..... 339/8 RL; 333/81 R; 334/43; 339/257

[58] Field of Search ..... 339/8 RL, 8 R, 14 RP, 339/257, 258 A, 258 R; 333/81, 82, 183; 334/43, 80

[56] References Cited

U.S. PATENT DOCUMENTS

| | | | |
|---|---|---|---|
| 2,523,664 | 9/1950 | Minnium et al. | 339/258 A |
| 2,824,965 | 2/1958 | Chalmers | 334/43 |
| 2,898,463 | 8/1959 | Honeywell et al. | 334/43 |

*Primary Examiner*—Roy Lake
*Assistant Examiner*—DeWalden W. Jones
*Attorney, Agent, or Firm*—Woodard, Weikart, Emhardt & Naughton

[57] ABSTRACT

A spring contact element is soldered to the end section of a plate holder hub in a high frequency tuneable cavity. The spring contact extends outwardly transverse to the shaft's principle direction and terminates in a plurality of radially extending contact fingers inclined toward and in contact with a wall of the cavity at the end of the hub. Attachment of the spring contact electrically at the plate holder hub and consequent moving contact between the cavity wall and the spring contact member at a circumference considerably larger than that at the hub provides reduced current densities in the vicinity of the moving contact between the wall and the spring contact and consequently considerably reduced power loss at high frequencies above 100 MHz.

5 Claims, 3 Drawing Figures

SPRING CONTACT FOR HIGH FREQUENCY ELECTRICAL SIGNALS

BACKGROUND OF THE INVENTION

1. Field of the Invention

This invention is in the field of contact apparatus, such as grounding contacts, between elements rotatably movable relative to one another in high frequency electrical apparatus.

2. Description of the Prior Art

In the past, contact, such as grounding contact, between a rotating shaft and a wall in a walled cavity for high frequency electrical signals has been accomplished through the use of spring washers approximately the same effective diameter as the shaft or other similar devices. Other grounding means have been utilized without particular regard to the requirement for maintaining a good high frequency electrical connection between the grounding element and the rotating shaft or have not been directed toward solving high frequency grounding problems. Some prior art is shown in U.S. Pat. No. 2,898,463 to Honeywell and U.S. Pat. No. 3,740,677 to Comrush. The use of a spring washer within a tube rather than for an end wall application is shown in U.S. Pat. No. 3,056,925 to Borke et al.

SUMMARY OF THE INVENTION

One embodiment of the present invention is an improved apparatus for effecting high frequency electrical contact with a walled member comprising a shaft element rotatably mounted on the walled member and having a first section adjacent a wall thereof, the wall extending essentially transverse to the principal dimension of the shaft, said first section including a first portion extending outwardly from the shaft and a second portion extending outwardly beyond the first portion, the second portion having a plurality of contact fingers inclined toward the wall, the shaft being mounted on the walled member such that the first and second portions are maintained near the wall with the fingers in continuous tensioned contact with the wall as the shaft element is rotated.

It is an object of the present invention to provide an improved contacting apparatus for a shaft rotatable relative to a wall in high frequency electrical apparatus by providing a plurality of tensioned fingers in contact with the wall at an increased radial distance from the shaft, thereby reducing the current density at the interface between the element electrically coupled to the shaft and the wall of the apparatus.

Further objects and advantages of the present invention shall be apparent from the following detailed description and accompanying figures.

DESCRIPTION OF THE PREFERRED EMBODIMENT

Figure 1:
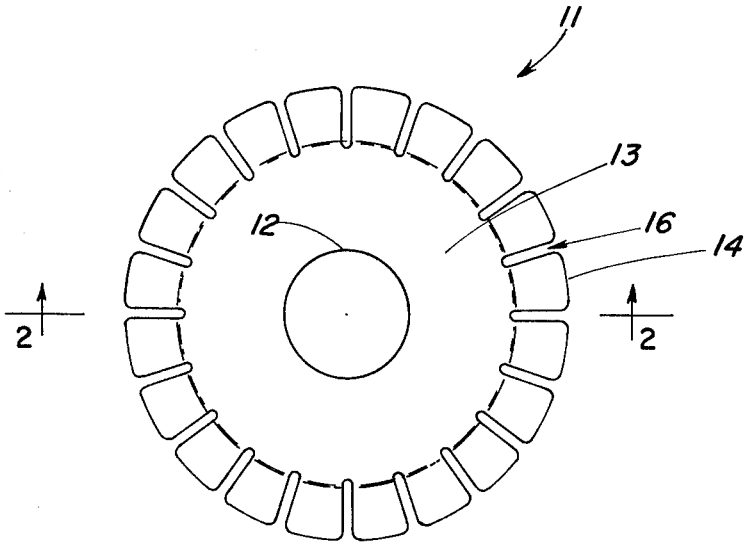
FIG. 1 is a top view of a spring contact element according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
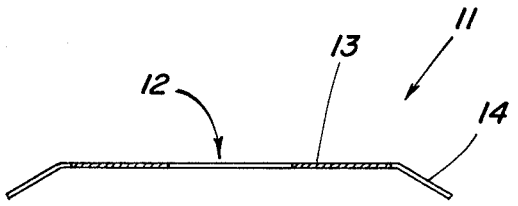
FIG. 2 is a side sectional view of the contact element of FIG. 1.

Referring now in particular to FIG. 1, there is shown a spring contact element 11 according to the present invention. As shown in FIGS. 1 and 2, spring contact element 11 has a circular central opening 12 which receives an end section of a plate holder hub to be described hereinafter, an annular first portion 13 surrounding opening 12, and a plurality of spring contact fingers 14 separated by radial slots 16 extending from portion 13. In an exemplary embodiment, hole 12 is 0.406 inches in diameter, first portion 13 is 1.100 inches in diameter to the point at which fingers 14 extend downwardly (FIG. 2), and fingers 14 are approximately 0.200 inches in a further radial direction beyond first portion 13. As shown in FIG. 2, fingers 14 extend about 0.100 inches below the surface of first portion 13. The spring contact element 11 is, in said exemplary embodiment, a beryllium copper alloy which is silver plated.

Figure 3:
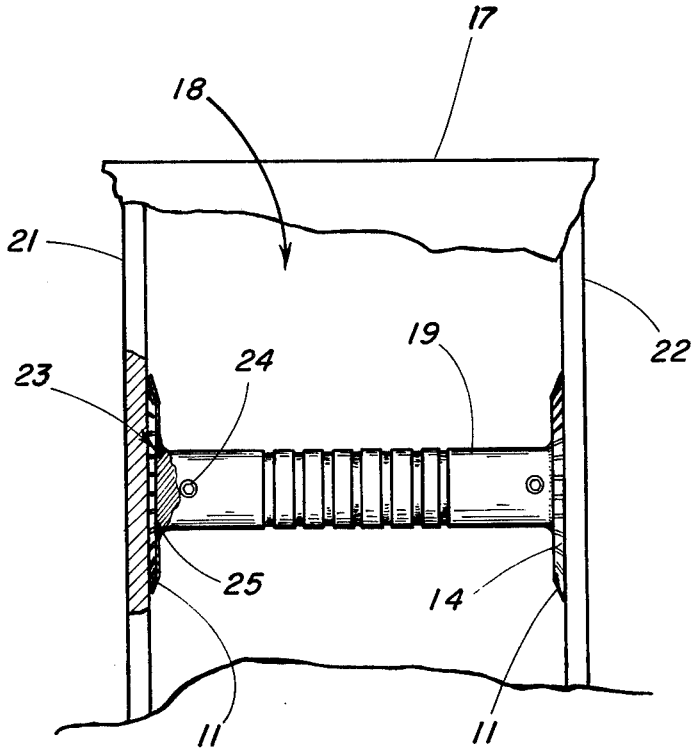
FIG. 3 is a top view of a tunetable cavity and plate holder hub with portions removed showing the mounting of two spring contact elements of FIG. 1 therein.

Referring now to FIG. 3, there is shown a portion of a multiple cavity tuneable filter apparatus designated generally as 17. Within one cavity 18 of the filter, a plate holder hub 19 is mounted between walls 21 and 22. A plurality of rotary capacitor plates (not shown) are mountable on hub 19 in normal operation.

Such multicavity filters are used for tuning high frequency signals from the range of VHF and upward, and it is important at such frequencies to provide an excellent RF contact between the rotating hub 19 and the walls of the cavity such as 21 and 22 so as to reduce insertion loss. In the present exemplary embodiment, this contact is an RF ground for the rotating shaft.

Each spring contact element 11 is mounted on a reduced diameter portion at an end of hub 19 as shown as 23 in the cut-away portion of FIG. 3. The reduced diameter portion of hub 19 has a diameter approximately the same as that of the center hole 12 in the spring contact element. Therefore, the spring contact is received with a slight force fit over the end of the hub 19. The spring contact is soldered to the hub to make continuous electrical contact therewith. The solder fillet 25 is complete and continuous with no cracks at the joint. The hub assembly is ideally plated with pure silver to a thickness of at least 3 skin depths for the lowest frequency at which it will be used. Thus, the silver provides a surface on the spring contact or first section 11 and a surface on the hub or shaft element 19 which surfaces are integral and connected and do not have discontinuities therebetween. Also the silver provides a mass which is beneath the surface of the silver on the spring contact or first section 11 and a mass which is beneath the surface of the silver on the hub or shaft element 19 which masses are integral and connected and do not have discontinuities therebetween.

In the exemplary embodiment shown, a stainless steel drive shaft is inserted inside the plate holder hubs of the various cavities and the hubs are attached by set screws such as 24. The hub 19 is positioned on the shaft relative to walls 21 and 22 such that the spring fingers 14 are placed under tension against the wall and flattened to about half their inital extension below flat portion 13.

That is, the surfaces of the spring fingers 14 lying against the side wall are about 0.050 inches from first portion 13. The use of a large number of fingers such as 14 provides excellent contact despite irregularities in the wall surface. If an irregularity is encountered at any point by the contacting lower surfaces of the contact fingers 14, only one particular contact finger will be affected rather than causing the entire spring contact element to be tilted at an angle. Also, the use of individual contacting fingers permits some adjustability of the apparatus since an accidentally bent portion may be more easily returned to its original shape.

The radial slots employed to separate the contacting fingers are generally in the direction of the surface currents, which tend to run parallel with the slots. This minimizes interruption of the current by the contacting finger separations. Due to the low current densitites at the contacting finger radius, as opposed to the radius adjacent the plate holder hub 19, any irregularities present have less effect on the current flow and thus, loss, should an irregularity occur.

The reduced diameter portion indicated at 23 on hub 19 is nonweight-bearing and principally serves for mounting of the spring contact element 11. Weight bearing is accomplished by bearings in holes through walls 21 and 22 which receive the stainless steel drive shaft on which the hubs 19 are mounted. The bearings are thereby shielded from the high frequency currents avoiding electrical discontinuity and subsequent loss. It is contemplated that the hub and spring contact element (or elements) may also be constructed as a single part, eliminating the solder connection therebetween. When the hub or shaft 19 and spring contact element or section 11 are constructed as a single part, the hub and spring contact element each have a surface which surfaces are connected and integral and do not have discontinuities therebetween. Also when the shaft 19 and spring contact element are constructed as a single part, a mass is provided which is beneath the surface of the hub and a mass is provided which is beneath the surface of the spring contact element which masses are integral and connected and do not have discontinuities therebetween.

While there have been described above the principles of this invention in connection with specific apparatus, it is to be clearly understood that this description is made only by way of example and not as a limitation in the scope of the invention.

What is claimed is:

1. An improved apparatus for effecting high frequency electrical contact with a member including a wall comprising a shaft element rotatably mounted on the member and having a first section adjacent said wall; said wall extending essentially transverse to the principal dimension of the shaft; said first section including a first portion extending outwardly from the shaft and a second portion extending outwardly beyond the first portion; the second portion having a plurality of contact fingers inclined toward the wall; the shaft being mounted on the member such that the first and second portions are maintained near the wall with the fingers in continuous tensioned contact with the wall as the shaft element is rotated; said shaft and section each having an outer surface and each having a mass beneath its outer surface, said shaft outer surface being integral with and connected to said section outer surface and shaft mass being integral with and connected to said section mass.

2. The apparatus of claim 1 in which the first portion and the second portion of the shaft element comprise a spring contact attached to the shaft of the shaft element in continuous conductive contact.

3. The apparatus of claim 2 in which the first portion is an annular apertured disc and the contact fingers of the second portion extend beyond the first portion in an annular array.

4. The apparatus of claim 3 in which the member is a tunable cavity.

5. The apparatus of claim 4 in which the first portion and second portion are a beryllium copper alloy; said shaft, first portion and second portion being silver plated to a thickness of at least three skin depths for the lowest frequency at which the apparatus will be used.

* * * * *